US005305933A

United States Patent [19]

Zuckerman

[11] Patent Number: 5,305,933

[45] Date of Patent: * Apr. 26, 1994

[54] HANGER WITH EASILY ATTACHABLE INFORMATION TAB

[75] Inventor: Andrew M. Zuckerman, Forest Hills, N.Y.

[73] Assignee: Different Dimensions Inc., Rego Park, N.Y.

[ * ] Notice: The portion of the term of this patent subsequent to Aug. 24, 2010 has been disclaimed.

[21] Appl. No.: 64,940

[22] Filed: May 20, 1993

Related U.S. Application Data

[60] Division of Ser. No. 943,820, Sep. 11, 1992, Pat. No. 5,238,159, which is a continuation-in-part of Ser. No. 801,613, Nov. 22, 1991, Pat. No. 5,199,608.

[51] Int. Cl.[5] ..... A47G 25/14

[52] U.S. Cl. ..... 223/85; 40/322

[58] Field of Search ..... 223/88, 85, 92, 95; 40/322, 658, 666; D6/315; 211/113

[56] References Cited

U.S. PATENT DOCUMENTS

| | | | |
|---|---|---|---|
| D. 244,197 | 5/1977 | Ostroll | D19/13 |
| 3,949,914 | 4/1976 | Ostroll | 223/85 |
| 4,115,940 | 9/1978 | Phillips | 40/322 |
| 4,997,114 | 3/1991 | Petrou | 223/85 |
| 5,096,101 | 3/1992 | Norman et al. | 223/85 |
| 5,199,608 | 4/1993 | Zuckerman | 223/85 |
| 5,238,159 | 8/1993 | Zuckerman | 223/85 |

*Primary Examiner*—Clifford D. Crowder
*Assistant Examiner*—Bibhu Mohanty
*Attorney, Agent, or Firm*—Amster, Rothstein & Ebenstein

[57] ABSTRACT

This invention is directed to a garment hanger having a tab holder for receiving an information tab wherein the information tab may be easily mounted onto the tab holder. Once the information tab is mounted onto the tab holder, it is securely and permanently affixed thereto.

10 Claims, 3 Drawing Sheets

HANGER WITH EASILY ATTACHABLE INFORMATION TAB

This is a divisional of copending application Ser. No. 07/943,820 filed on Sep. 11, 1992, now U.S. Pat. No. 5,238,159, itself a continuation-in-part of U.S. patent application Ser. No. 07/801,613, filed Nov. 22, 1991, now U.S. Pat. No. 5,199,608.

FIELD OF THE INVENTION

This invention relates to a hanger having an irremovable information tab. Specifically, this invention is directed to a garment hanger having a tab holder for receiving an information tab wherein the information tab may be easily mounted onto the tab holder and, once attached to the tab holder, cannot be removed by hand.

BACKGROUND OF THE INVENTION

Because it is desirable to provide garment hangers which are capable of displaying information such as the size or brand of a garment to prospective customers, various means of displaying information on garment hangers have been developed. In addition, it is desirable to provide other types of hangers such as display hangers for displaying swatches of fabric or carpet, which hangers are capable of displaying information to prospective customers.

One known method for displaying information on a garment hanger involves placing disks or tabs with printed information thereon (information tabs) over the hook of a hanger. However, information tabs of this type are easily dislodged or removed, and may cause confusion among customers.

Another known method for displaying information on a hanger involves printing information on a tab which is connected to the hanger by means of spring clips that are provided with a finger purchase. Again, such information tabs are easily removed, and therefore also may result in confusion among customers. In addition, hangers of this type are typically sold with the garments they carry. Once the hanger is in the home of the customer, the removable information tab is easily dislodged, and may pose a danger to children, if swallowed.

Another method for providing information on a hanger includes printing information on a tab which tab is pressed or snapped onto a tab holder attached to the hanger. The tab holder has a free edge and ridges which extend parallel to the free edge of the tab holder. The information tab has ribs for gripping the ridge of the tab holder, as well as a face member for displaying information. The ridge of the tab holder is positioned such that the information tab is pressed or snapped onto the tab holder. However, it is difficult to press the information tab onto the tab holder, and an attempt to press the information tab onto the tab holder may cause finger injury or nail breakage. This is especially significant since the tabs are initially attached to the tab holder at the manufacturing level and an operator may attach 200 to 300 tabs in a single day.

To date, no garment hanger which is capable of displaying information in a manner which is secure, permanent and easily achieved has been provided. Specifically, no garment hanger having an information tab which is easily mountable and suitable for distribution to purchasers of garments has been provided.

It is therefore an object of this invention to provide a hanger which is capable of displaying information wherein the manner of displaying information is secure and permanent.

It is a further object of this invention to provide a hanger with an information tab which is easily mounted onto the hanger, but is not removable from the hanger by hand once it is mounted.

It is still another object of this invention to provide an information tab which may be easily attached to a variety of hangers regardless of the physical characteristics of the body or hook proportions of the hanger.

It is a still further object of this invention to provide a hanger having a tab holder which is integrally formed as part of the hanger wherein an information tab suitable for displaying information is easily, securely and permanently attached to the tab holder.

SUMMARY OF THE INVENTION

This invention is directed to a garment hanger having a resilient, removal-resistant information tab attached thereto. The hanger comprises a body and a hook member, with a tab holder formed integrally thereon. The tab holder has two opposite sides, a free upper edge connecting the opposite sides, wherein the free upper edge contains thereon an upper ridge extending along the top of the free upper edge and having a break therein sc as to enable an information tab to be threaded thereon. The tab holder also has a lower ridge spaced below the free upper ridge. The garment hanger of this invention also has an information tab which is resilient and resistant to removal from the tab holder wherein the tab has a face member, two opposing tab ends, two opposing tab sides which extend from the face member and terminate in foremost edges opposite the face member, and a rib disposed on the inner surface of each opposing tab side. The information tab can be threaded onto and then forced downwardly onto the tab holder, whereupon the ribs on the inner surface of the opposing tab sides cooperatively engage the upper ridge to lock the tab onto the tab holder, such that the foremost edges of the opposing tab sides border the lower ridge.

BRIEF DESCRIPTION OF THE DRAWING

The above brief description, as well as further objects and features of the present invention, will be more fully understood by reference to the following detailed description of the presently preferred, albeit illustrative embodiments of the present invention when taken in conjunction with the accompanying drawing wherein.

DETAILED DESCRIPTION OF THE INVENTION

Figure 1:
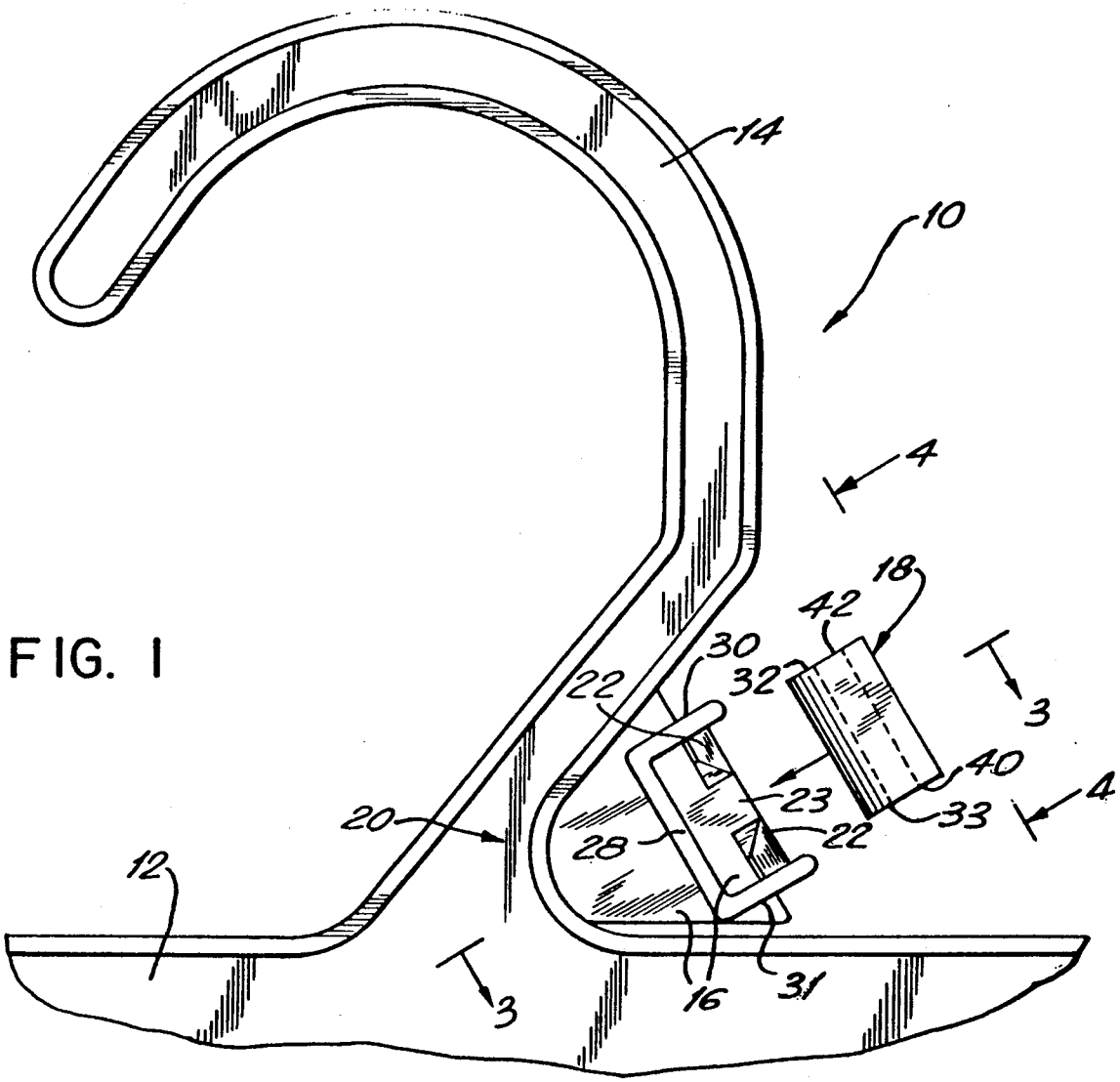
FIG. 1 is a fragmentary side elevational view of a preferred embodiment of the garment hanger of the present invention, prior to mounting the information tab thereon.

Referring to the drawing, FIG. 1 illustrates a garment hanger, generally designated by the reference numeral 10. As used herein, the term "garment hanger" is understood to refer to hangers for clothing, as well as hangers for non-clothing items. Hanger 10 includes a body 12, a hook member 14, and a tab holder 16. Hook member 14 may take any shape, such as the curved shape shown in FIG. 1, or for example, a straight nail. Tab holder 16 is adapted to easily receive and securely hold an information tab 18. Information tab 18 typically may be used to display information, such as the size or brand of a garment.

Garment hanger 10 can be planar or contoured. Hanger 10 and information tab 18 may be formed of any suitable material, such as polystyrene, polypropylene, ABS, or Nylon. Hook member 14 alternatively may be formed of metal. The hanger typically may be constructed using conventional injection molding techniques, though other techniques may be used.

Tab holder 16 preferably is integrally formed with body 12. Tab holder 16 preferably joins hook member 14 (or body 12) along a single edge 20, and extends in the plane of the hanger. By virtue of this design, tab holder 16 may be formed in any desired shape and size. The tab holder 16 may have more than one free edge. Tab holder 16 may attach to either or preferably both of body 12 and hook member 14. In either embodiment, a single information tab model (of a predetermined size and shape) may be compatible with several models of garment hangers varying in design and size.

Figure 2:
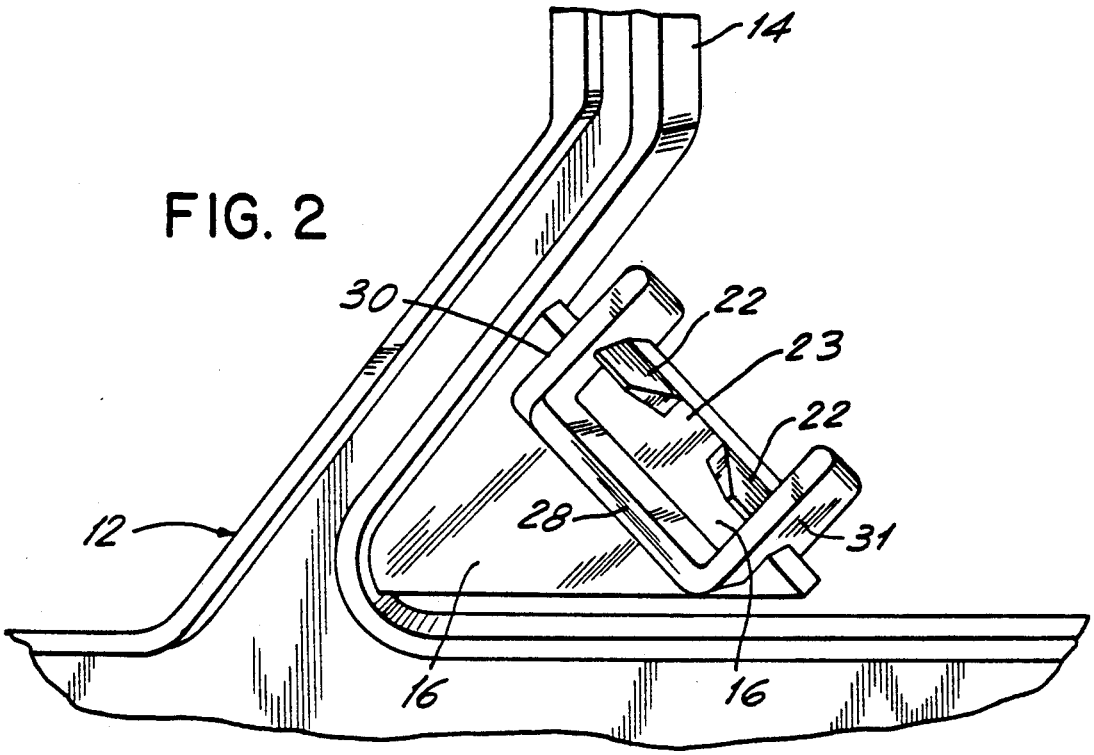
FIG. 2 is a fragmentary isometric view of the hanger of FIG. 1, prior to mounting the information tab thereon.
Figure 3:
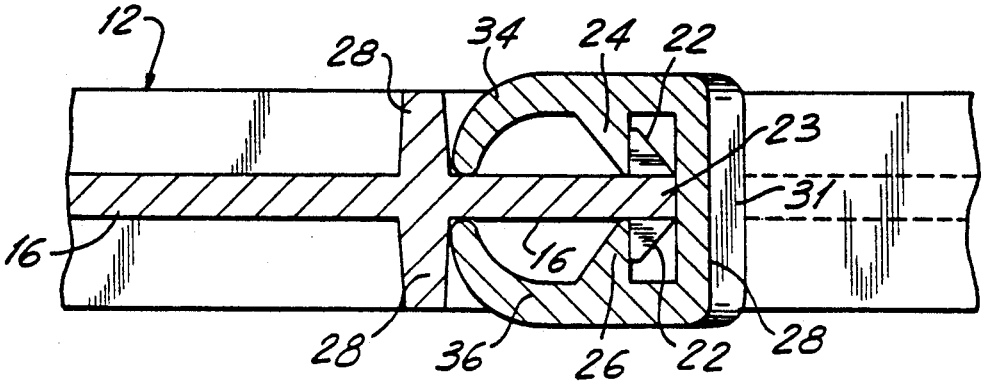
FIG. 3 is a cross-sectional view of the tab and tab holder of FIG. 1, taken along line 3—3 of FIG. 1.

As shown in FIG. 2, tab holder 16 includes an upper ridge 22 with a break 23 in it as it extends along the top (at both sides) of a free upper edge of the tab holder 16 for mounting the information tab 18. As shown in FIG. 3, projecting members 24 and 26 (referred to herein as "ribs") of tab 18 cooperatively engage the upper ridge 22. Tab holder 16 includes a lower ridge 28, which is parallel to and spaced apart from upper ridge 22. Ridges 22 and 28 extend outward from the plane of the tab holder, extending from both sides of the tab holder.

Tab holder 16 typically may include end members 30 and 31. End members 30 and 31 define the position along upper ridge 22 at which the tab may be attached to the tab holder. Lower ridge 28 and end members 30 and 31 prevent a customer from obtaining a finger purchase on tab 18 sufficient to clear projecting members 24 and 26 from upper ridge 22, thereby rendering tab 18 irremovable once the tab is mounted. As used herein, an "irremovable" tab refers to a tab which cannot easily be removed by an adult, and cannot be removed by a child of an age likely to ingest tab 18, without the use of a tool. This feature is desirable, for example, when a hanger is given to a customer along with the garment it carries. The irremovable nature of the information tab minimizes the danger to small children in the customer's home. Hangers with irremovable tabs are also useful in preventing inadvertent dislodging and possible subsequent mislabelling of garments in a store. Once tab 18 is mounted by store personnel, it cannot be accidentally dislodged by customers. If the tab must be changed, the store personnel can remove the tab, without damaging tab holder 16, using a tool.

Although the tab has been described as being removable using tools, it is within the scope of this invention to construct a hanger with an information tab which cannot be removed, without breaking the tab, even using a tool. The location of lower ridge 28 and end members 30 and 31 on the tab holder can be selected to vary the level of difficulty associated with removing tab 18. For example, positioning end members 30 and 31 and/or lower ridge 28 such that tab 18 f its snugly between and against them when the tab is mounted on tab holder 16 makes the tab difficult to remove, even when a tool is used. End members 30 and 31 and lower ridge 28 typically may also prevent a customer from obtaining a finger (or fingernail) purchase on the edge surfaces 32 and 33 of the tab 18. The dimensions and location of ridge 28 and end members 30 and 31 relative to the plane and edges of the tab holder also can be selected to increase or decrease the ease with which tab 18 can be removed.

Figure 4:
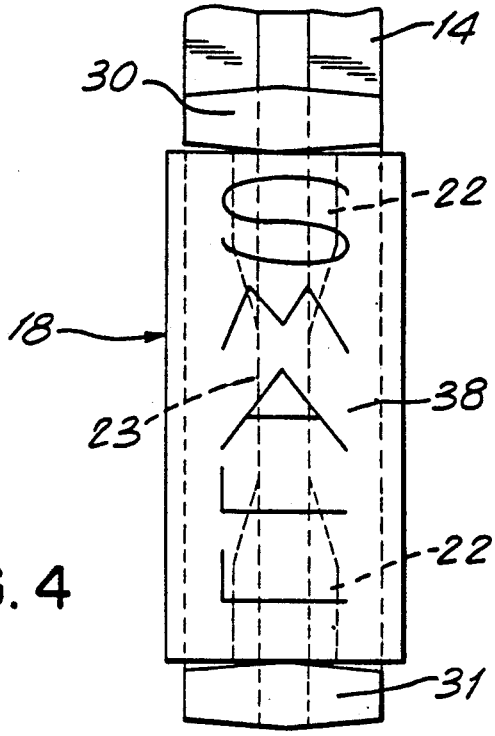
FIG. 4 is a side view of the tab of FIG. 1, taken along line 4—4 of FIG. 1.

Referring now to FIGS. 3 and 4, information tab 18, which is resilient, includes a face member 38 and two opposing tab sides 34 and 36 which extend synclinally from the face member 38. Face member 38 may bear information in the form of label, molded or raised lettering, or any other suitable form (see FIG. 4). Alternatively, face member 38 may be blank or suitable for marking by hand. Projecting members, referred to herein as ribs, 24 and 26 are disposed on the interior surfaces of opposing tab sides 34 and 36.

Figure 5:
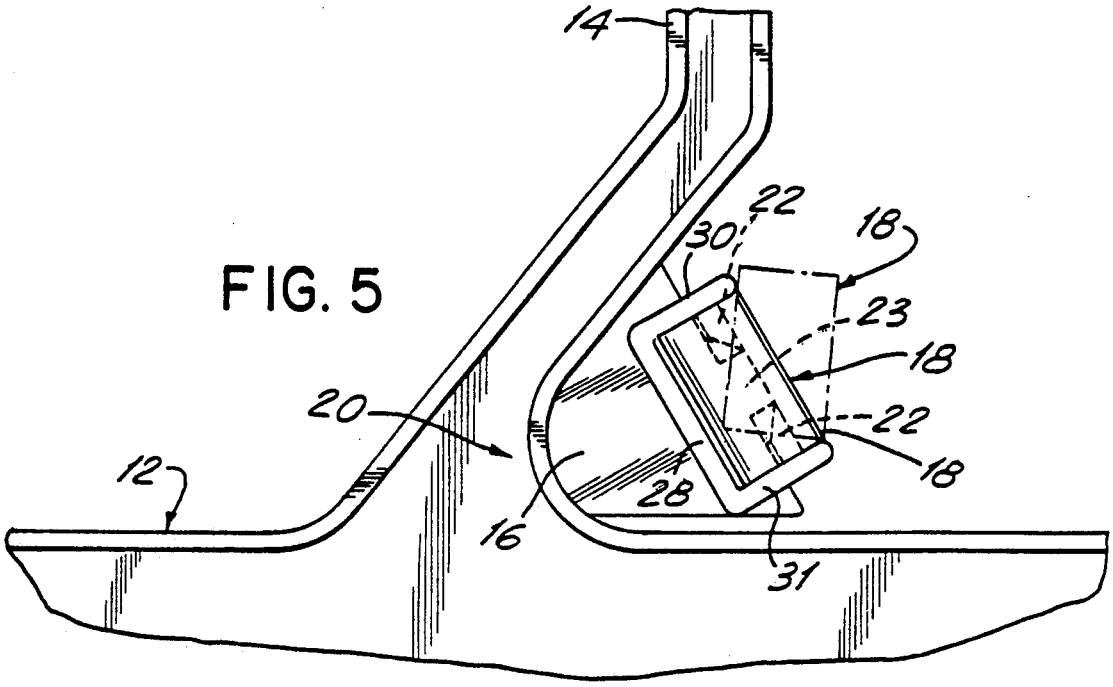
FIG. 5 is a fragmentary side elevational view of a preferred embodiment of the garment hanger of the present invention wherein the information tab is both fully (solid line) partially (in phantom line) mounted onto the tab holder.

To mount information tab 18 onto tab holder 16, information tab 18 should be gripped at the opposing tab sides 34 and 36 with the thumb and forefinger. One end 40 of information tab 18 is then placed into the break 23 in the upper ridge 22 and pushed along the upper ridge 22 by using a forward sliding or threading action. At this point, as illustrated in FIG. 5 in phantom line, the upper ridge 22 is in place between the face member 38 and the ribs 24, 26 at end 40 of the information tab 18. Next, the other end 42 of the information tab 18 is forced downwardly over the upper ridge 22, the upper ridge 22 briefly camming the tab sides 34, 36 outwardly until they pass through and return to their original orientation close together, now grasping below upper ridge 22. At this point, as illustrated in FIG. 5 in solid line, the entirety of the ribs 24, 26 are situated below the upper ridge 22 and the foremost edges of opposing tab sides 34 and 36 are adjacent to the lower ridge 28. Preferably the foremost edges are smooth or bevelled to prevent a person from obtaining a finger purchase on information tab 18. Preferably, and as discussed above, the foremost edges of opposing tab sides 34 and 36 are sufficiently close to lower ridge 28 to prevent a person from readily inserting a finger or fingernail between the foremost edge of opposing tab sides 34 and 36 and lower ridge 28, and end members 30 and 31 are similarly sufficiently close to tab edge surfaces 32 and 33.

Accordingly, this invention is directed to a garment hanger having a tab holder for receiving an information tab wherein the information tab may be easily threaded onto and then forced downwardly onto the tab holder and, once attached to the tab holder, cannot be removed by hand. The garment hanger of this invention comprises a body and a hook member, with a tab holder formed integrally thereon. The tab holder comprises two opposite sides, a free upper edge connecting the opposite sides, an upper ridge extending along the top of the free upper edge and having a break therein so as to enable an information tab to be threaded thereon, and a lower ridge spaced below the upper ridge extending from the two opposite sides of the tab holder. The garment hanger of this invention also includes an information tab which is resilient and resistant to manual removal from the tab holder once it is threaded thereon. The information tab has a face member upon which information can be imprinted. It also has two opposing tab ends, and two opposing tab sides extending from the face member, terminating in foremost edges opposite the face member. The two opposing tab sides each have a rib disposed on the inner surface thereof for cooperatively engaging the upper ridge of the tab holder in order to lock the information tab into the tab holder. Information may also be imprinted on the outer surface of the tab sides. When the ribs cooperatively engage the upper ridge, the foremost edges of the information tab border the lower ridge of the tab holder, and the tab edge surfaces border the end members of the tab holder.

In order to mount the information tab onto the tab holder, one should hold the opposing tab sides of the information tab with the thumb and forefinger and place one opposing tab end of the information tab through the break in the upper ridge and onto the tab holder by using a sliding or threading action. Once the information tab is threaded past the break and onto the upper ridge, the remaining opposing tab end of the information tab, which has not yet engaged the tab holder, is forced downwardly over the upper ridge, such that the upper ridge is briefly camming the opposing tab sides outwardly until they pass thereover and return to their original orientation, thereby cooperatively engaging the upper ridge. Once the information tab has been mounted onto the tab holder via the break, the tab is manually irremovable and resistant to accidental removal. At this point, the foremost edges of the information tab border the lower ridge of the tab holder.

In summary, this invention is directed to a garment hanger which is capable of displaying information in a manner which is easily achieved, wherein the manner of displaying the information is secure and permanent. The garment hanger of this invention provides for the attachment of an information tab to a tab holder, wherein the information tab is resistant to both accidental and intentional manual removal from the tab holder. The information tab of this invention may be easily attached to a variety of hangers, regardless of the physical characteristics or body or hook portions of the hangers, provided that the hangers include a tab holder.

Although this invention herein has been described with reference to particular embodiments, it is to be understood that these embodiments are merely illustrative of various aspects of the invention. Thus, it is to be understood that numerous modifications may be made in the illustrative embodiments and other arrangements may be devised without departing from the spirit and scope of the invention.

I claim:

1. A garment hanger including an easily attachable tab comprising:

a hanger including a body and a hook member;

a tab holder formed integrally with said hanger, said tab holder having two opposite sides, a free upper edge connecting said opposite sides, said free upper edge containing thereon an upper ridge extending along the top of said free upper edge; and a resilient tab, said tab having a face member, two opposing tab ends and two opposing tab sides, said opposing tab sides extending from said face member and terminating in foremost edges adjacent said face member, said two opposing tab sides each having a projecting member disposed on the inner surf ace thereof for cooperatively engaging said upper ridge to lock said tab to said tab holder;

said upper ridge having a break therein so as to enable one end of said tab to be threaded onto said upper ridge.

2. The garment hanger of claim 1 wherein, once said one end of said tab has been threaded onto said upper ridge, said upper ridge is configured and dimensioned to temporarily cam said tab sides outwardly as the other of said ends of said tab is forced downwardly over said upper ridge, thereby locking said tab onto said tab holder.

3. The garment hanger of claim 1, wherein said tab holder further comprises a second free edge.

4. The garment hanger of claim 1, wherein said face member displays information.

5. The garment hanger of claim 1, wherein said opposing tab sides extend synclinally from said face member.

6. The garment hanger of claim 1, wherein the projecting member is a rib.

7. The garment hanger of claim 1, wherein said tab holder is located between said hook member and said body.

8. The garment hanger of claim 1, wherein said foremost edges are bevelled.

9. A garment hanger including an easily attachable tab comprising:

a hanger including a body and a hook member;

a tab holder formed integrally with said hanger, said tab holder having two opposite sides, a free upper edge connecting said opposite sides, said free upper edge containing thereon an upper ridge extending along the top of said free upper edge and a lower ridge extending from said two opposite sides and spaced below said upper ridge; and a resilient tab resistant to both accidental and intentional manual removal from said tab holder, having a face member, two opposing tab ends and two opposing tab sides, said opposing tab sides extending from said face member and terminating in the foremost edges opposite said face member, said two opposing tab sides each having a projecting member disposed on the inner surface thereof for cooperatively engaging said upper ridge to lock said tab to said tab holder;

said upper ridge having a break therein enabling said tab to be threaded onto said upper ridge;

whereby once said one end of said tab has been threaded onto said upper ridge, said upper ridge is configured and dimensioned to cam said tab sides outwardly when said other of said ends is forced downwardly over said upper ridge, thereby locking said tab onto said tab holder.

10. The garment hanger of claim 9 wherein:

said tab holder includes an upper end member formed above said upper ridge and a lower end member formed below said upper ridge;

said face member and said two opposing sides cf said tab forming an upper edge surface and a lower edge surface;

said upper and lower end members of said tab holder being located relative to said respective upper and lower edge surf aces of said tab such that, when said tab is locked on to said tab holder, said upper and lower end members obstruct access to said respective upper and lower edge surfaces.

* * * * *